US006972722B2

(12) United States Patent
Katoh et al.

(10) Patent No.: US 6,972,722 B2
(45) Date of Patent: Dec. 6, 2005

(54) ANTENNA UNIT AND WIRELESS COMMUNICATION APPARATUS

(75) Inventors: Katsutoshi Katoh, Tokyo-to (JP); Kazuhiko Maeda, Yokohama (JP)

(73) Assignee: Lenovo (Singapore) Pte. Ltd., Singapore (SG)

( * ) Notice: Subject to any disclaimer, the term of this patent is extended or adjusted under 35 U.S.C. 154(b) by 10 days.

(21) Appl. No.: 10/730,322

(22) Filed: Dec. 8, 2003

(65) Prior Publication Data

US 2004/0174306 A1 Sep. 9, 2004

(30) Foreign Application Priority Data

Mar. 3, 2003 (JP) ..... 2003-056376

(51) Int. Cl.[7] ..... H01Q 1/24
(52) U.S. Cl. ..... 343/702; 343/700 MS
(58) Field of Search ..... 343/702, 700 MS, 343/846

(56) References Cited

U.S. PATENT DOCUMENTS 6,646,607 B2 * 11/2003 Usui et al. ..... 343/700 MS
6,812,892 B2 * 11/2004 Tai et al. ..... 343/700 MS

* cited by examiner

*Primary Examiner*—Shih-Chao Chen
(74) *Attorney, Agent, or Firm*—William N. Hogg; Driggs, Lucas, Brubaker & Hogg Co., LPA

(57) ABSTRACT

An antenna unit is provided in a wireless communication apparatus which performs wireless communication. The antenna unit has a radio wave resonance part through which a radio wave is transmitted or received, an antenna ground part electrically connected to the radio wave resonance part, and a connection part which fixes the antenna ground part at such a position that the antenna ground part is closer to the radio wave resonance part than other ground parts of the wireless communication apparatus.

2 Claims, 6 Drawing Sheets

[Figure 1]
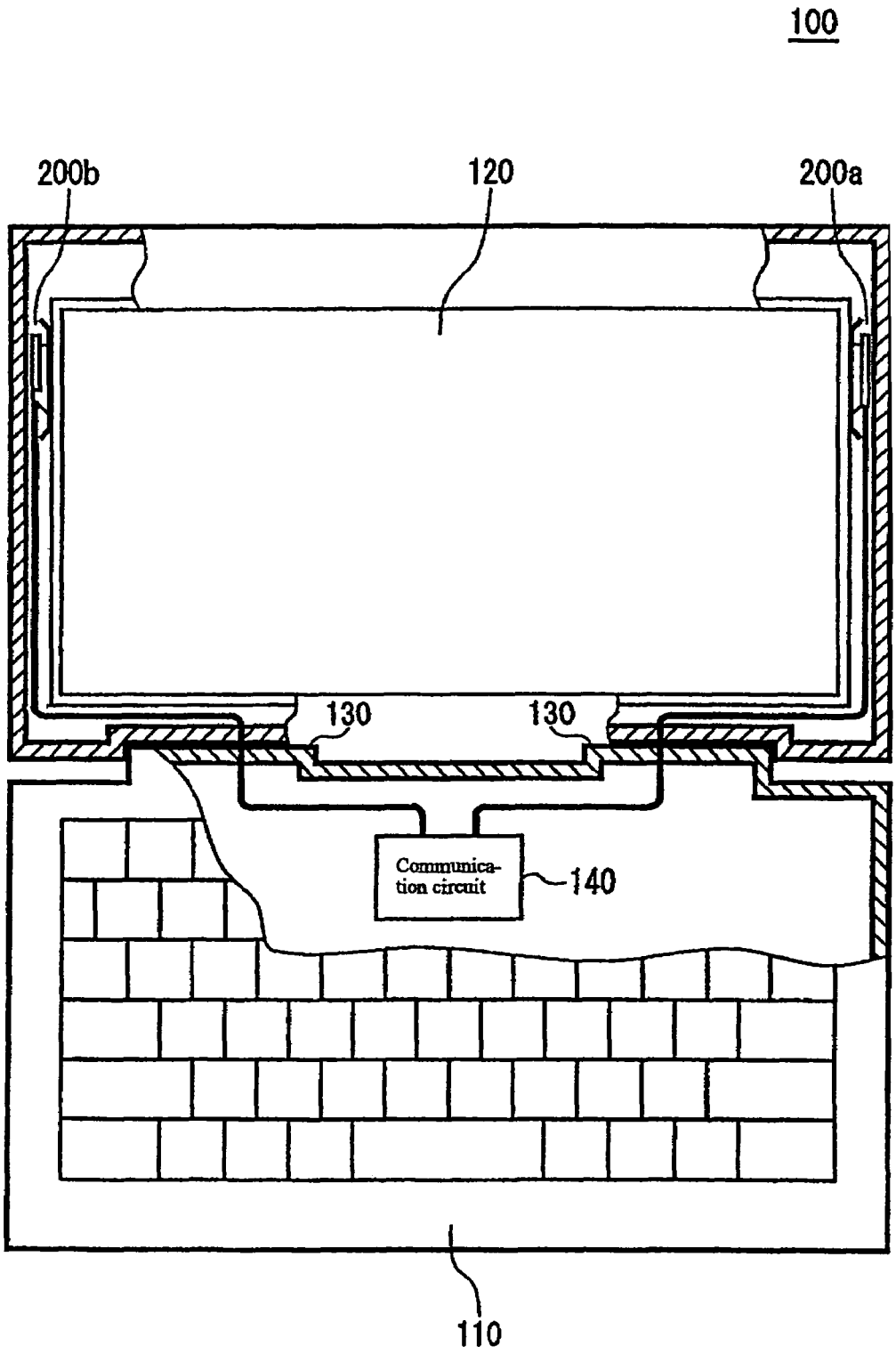

[Figure 2]
(a)
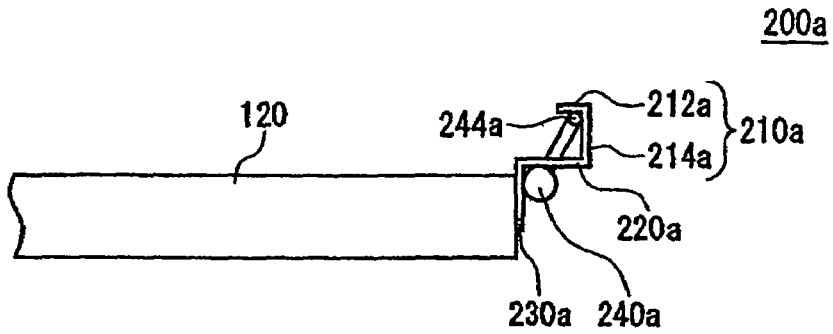
(b)
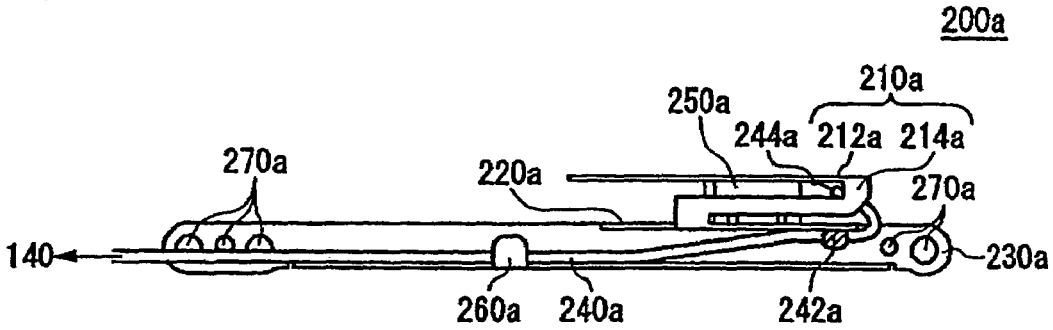
(c)
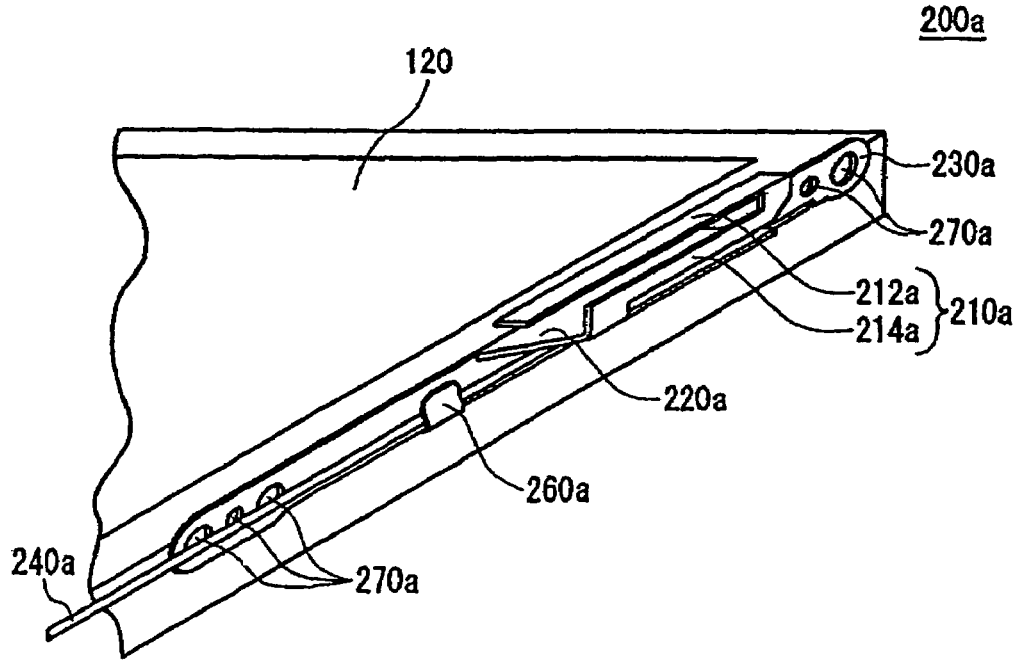

[Figure 3]
(a)
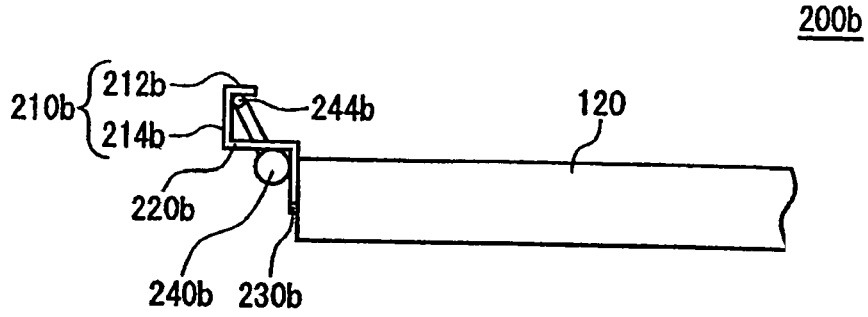
(b)
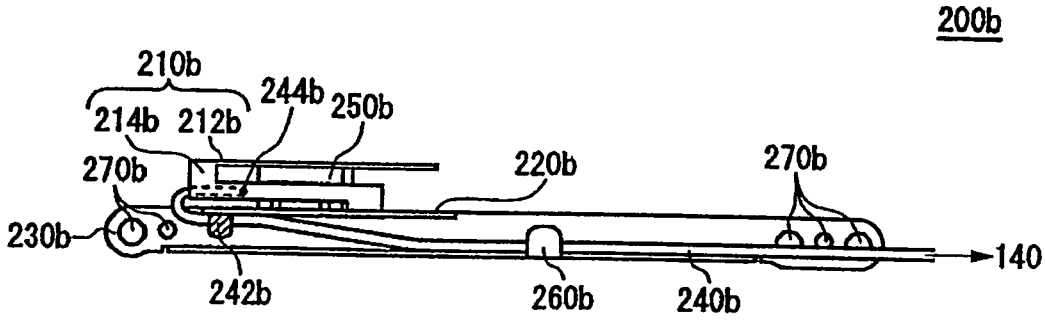
(c)
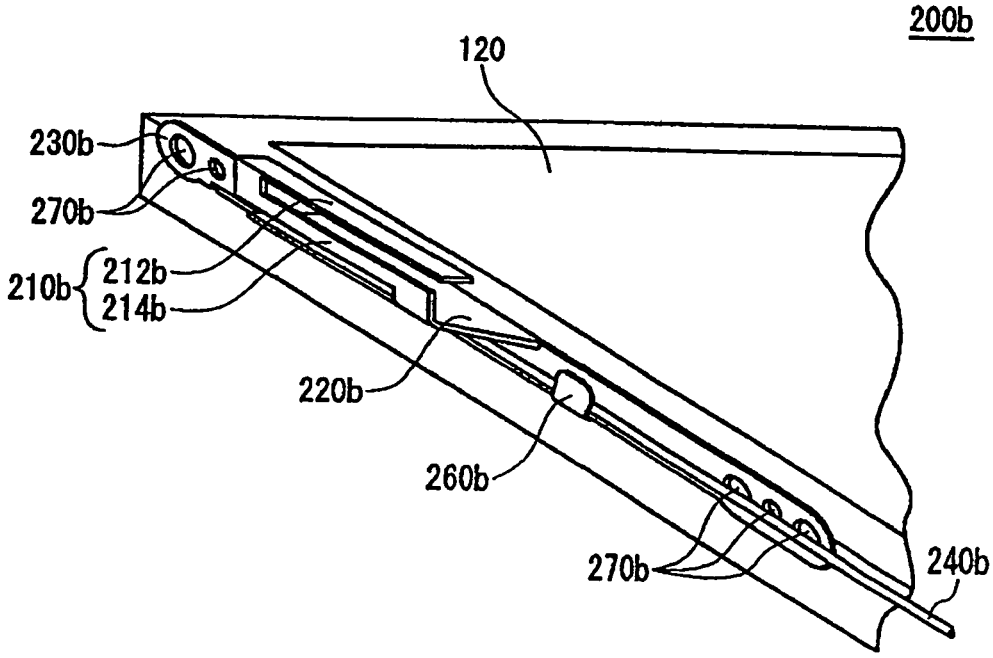

[Figure 4]
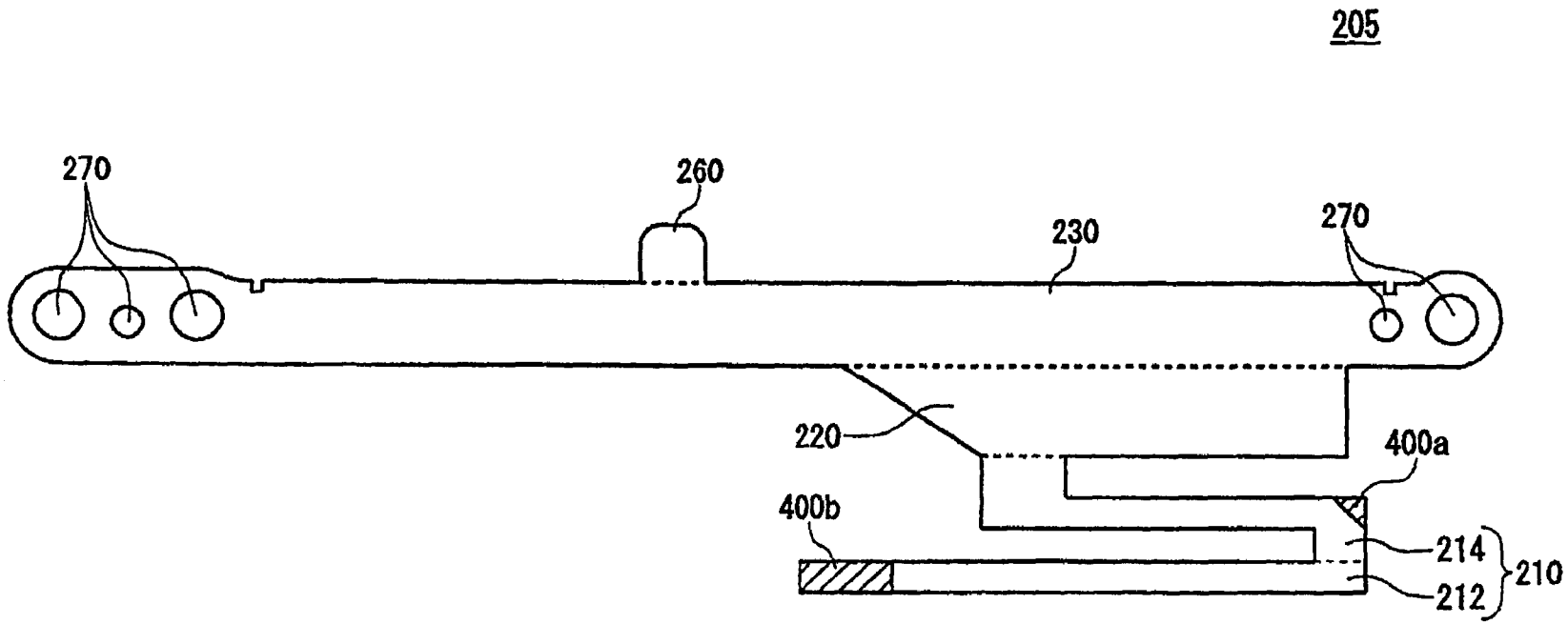

[Figure 5]
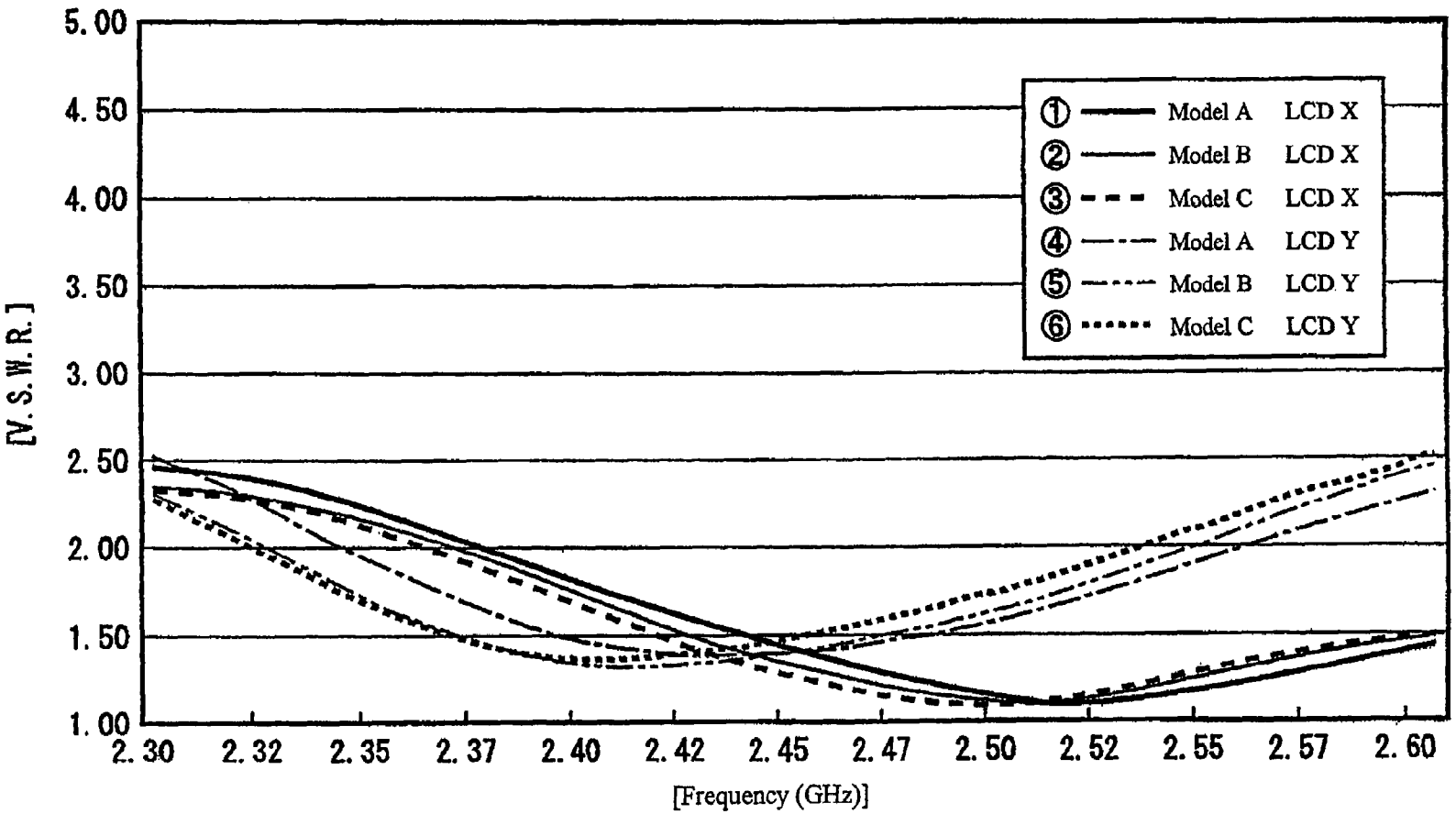

[Figure 6]
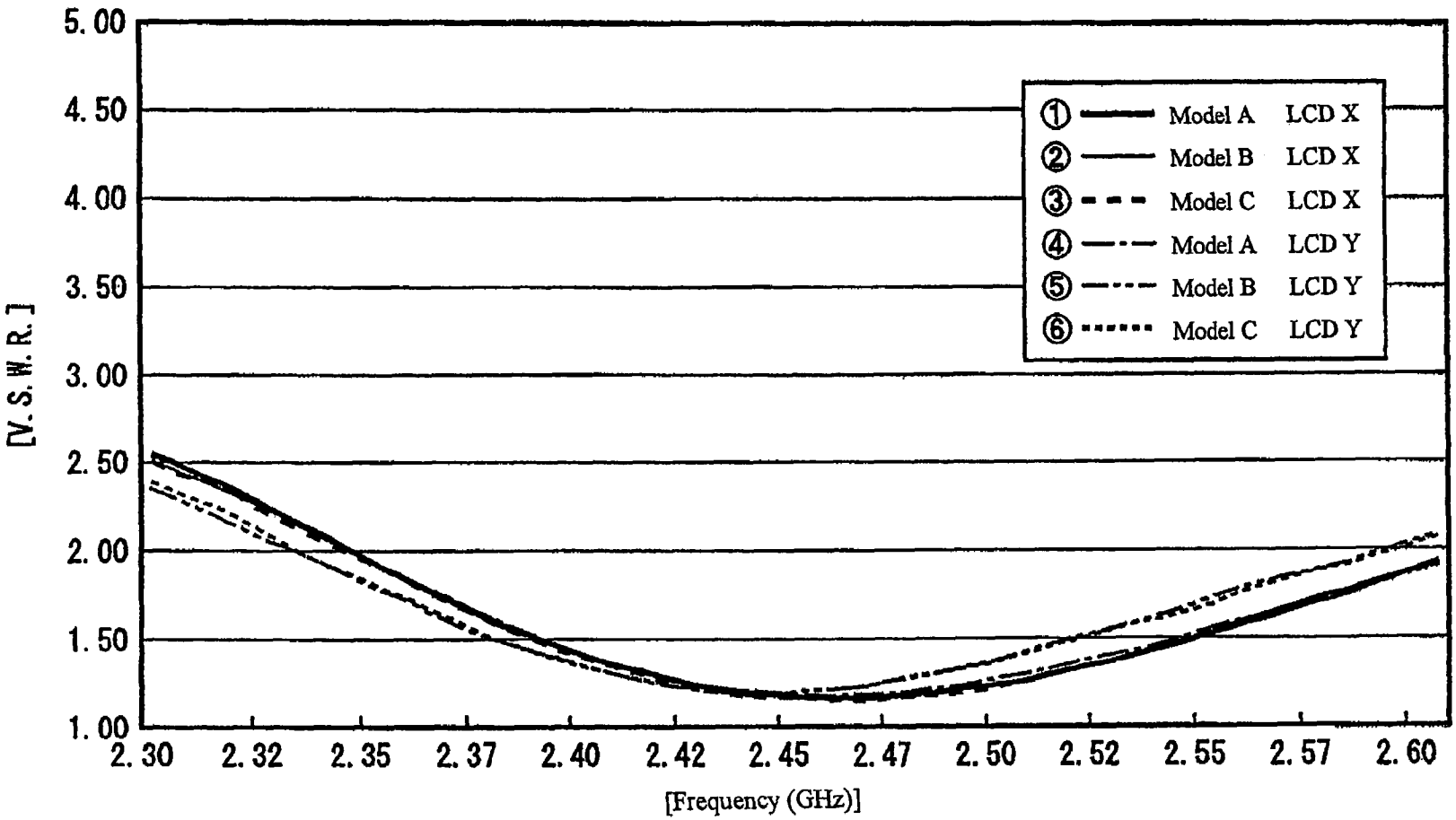

ANTENNA UNIT AND WIRELESS COMMUNICATION APPARATUS

BACKGROUND OF THE INVENTION

1. Field of the Invention

The present invention relates, in general, to an antenna unit and a wireless communication apparatus. More particularly, the present invention relates to an antenna unit which is provided in a wireless communication apparatus for performing wireless communication, and in which variations in antenna characteristics depending on surrounding parts are limited, and to a wireless communication apparatus using the antenna unit.

2. Description of Related Art

In recent years, information processors such as personal computers and PDAs incorporating wireless LAN functions and standards such as IEEE802.11a/b/g and Bluetooth® have come into wide use. In information processors having wireless LAN functions, it is desirable to realize an antenna such that the influence of internal parts or the like of the information processor on the antenna is reduced and the antenna has stable characteristics.

As a method for limiting the influence of noise or the like from an information processor on an antenna, a method of using, for example, a shielding member of a display panel as a ground circuit for an antenna has been proposed (for instance see Published Unexamined Japanese Patent Application Laid-Open No. 2000-174527).

In certain of the wireless LAN functions, such as IEEE802.11a/b/g and Bluetooth, different frequency bands in accordance with the standards may be used and, therefore, it is often desirable to realize or utilize all the frequency bands by one antenna. In order to achieve this, it is necessary to determine characteristics of the antenna including impedance with higher accuracy at the time of manufacturing and assembly.

However, in a case where one antenna is used in concert with a system utilizing in a plurality of information processor types, the characteristics of the antenna are often changed for a variety of reasons including the position or location of parts and the arrangement of the display panel, each of which may also be dependent on the particular kind of processor used. For example, in one information processor, the characteristics of the antenna may be affected by variations in the position of certain parts and wiring, whereas if another information processor were used, similar effects would not be realized.

SUMMARY OF THE INVENTION

Accordingly, there is a need for an invention that overcomes the problems discussed above. The present invention has been achieved to solve the above technical problems, and accordingly an object of the present invention is to provide an antenna unit and a wireless communication apparatus capable of solving the above-described problems.

According to a first aspect of the present invention, there is provided an antenna unit in a wireless communication apparatus which performs wireless communication, the antenna unit having a radio wave resonance part through which a radio wave is transmitted or received, an antenna ground part electrically connected to the radio wave resonance part, and a connection part which fixes the antenna ground part in such a position that the antenna ground part is closer to the radio wave resonance part than other ground parts of the wireless communication apparatus.

According to a second aspect of the present invention, there is provided an antenna unit in a wireless communication apparatus which performs wireless communication, the antenna unit having a radio wave resonance part through which a radio wave is transmitted or received, an antenna ground part connected to ground, and a connection part which fixes the antenna ground part in such a position that the antenna ground part is closer to the radio wave resonance part than other ground parts of the wireless communication apparatus, and a feeder laid to the radio wave resonance part at a distance from the antenna ground part, a shielding conductor of the feeder being connected to the antenna ground part on the opposite side of the antenna ground part from the radio wave resonance part, a signal conductor of the feeder being connected to the radio wave resonance part.

According to a third aspect of the present invention, there is provided a wireless communication apparatus which performs wireless communication, the apparatus having a radio wave resonance part through which a radio wave is transmitted or received, an antenna ground part electrically connected to the radio wave resonance part, and a connection part which fixes the antenna ground part in such a position that the antenna ground part is closer to the radio wave resonance part than other ground parts of the wireless communication apparatus.

According to a fourth aspect of the present invention, there is provided wireless communication apparatus which performs wireless communication, the apparatus having a radio wave resonance part through which a radio wave is transmitted or received, an antenna ground part connected to ground, and a connection part which fixes the antenna ground part in such a position that the antenna ground part is closer to the radio wave resonance part than other ground parts of the wireless communication apparatus, and a feeder laid to the radio wave resonance part at a distance from the antenna ground part, a shielding conductor of the feeder being connected to the antenna ground part on the opposite side of the antenna ground part from the radio wave resonance part, a signal conductor of the feeder being connected to the radio wave resonance part.

BRIEF DESCRIPTION OF THE DRAWINGS

Other aspects, features, and advantages of the present invention will become more fully apparent from the following detailed description, the appended claims, and the accompanying drawings in which:

FIG. 1 shows the structure of an information processor 100 in accordance with an embodiment of the present invention;

FIG. 2 shows the structure of an antenna unit 200*a* in accordance with an embodiment of the present invention;

FIG. 2(*a*) is a view of the antenna unit 200*a* in accordance with an embodiment of the present invention as seen from the input portion 110 side of a display portion 120;

FIG. 2(*b*) is a view of the antenna unit 200*a* in accordance with an embodiment of the present invention as seen in a direction toward a side surface of the display portion 120;

FIG. 2(*c*) is a perspective view of the antenna unit 200*a* in accordance with an embodiment of the present invention;

FIG. 3 shows the structure of an antenna unit 200*b* in accordance with an embodiment of the present invention;

FIG. 3(*a*) is a view of the antenna unit 200*b* in accordance with an embodiment of the present invention as seen from the input portion 110 side of the display portion 120;

FIG. 3(*b*) is a view of the antenna unit 200*b* in accordance with an embodiment of the present invention as seen in a direction toward a side surface of the display portion 120;

FIG. 3(*c*) is a perspective view of the antenna unit 200*b* in accordance with an embodiment of the present invention;

FIG. 4 shows the configuration of an antenna part 205 which is a part for the antenna units 200*a* and 200*b* in accordance with an embodiment of the present invention;

FIG. 5 shows voltage standing wave ratio (VSWR) characteristics of an antenna not having the antenna ground part 220 in accordance with an embodiment of the present invention; and FIG. 6 shows VSWR characteristics of the antenna unit 200 in accordance with an embodiment of the present invention.

DETAILED DESCRIPTION

The use of figure reference labels in the claims is intended to identify one or more possible embodiments of the claimed subject matter in order to facilitate the interpretation of the claims. Such labeling is not to be construed as necessarily limiting the scope of those claims to the embodiments shown in the corresponding figures. The preferred embodiments of the present invention and its advantages are best understood by referring to the drawings, like numerals being used for like and corresponding parts of the various drawings. Embodiments of the present invention will now be described in detail with reference to the accompanying drawings, wherein the embodiments described below, however, are not limiting to the invention set forth and all combinations of features described in any of the descriptions of any embodiment are not necessarily indispensable to the solution according to the present invention.

FIG. 1 shows the structure of an information processor 100 in accordance with an embodiment of the present invention. The information processor 100 is an example of the wireless communication apparatus in accordance with the present invention. The information processor 100 performs wireless communication with another unit. The information processor 100 has an input portion 110 through which an operation performed by a user of the information processor 100 is received as an input, a display portion 120 through which information is output to the user of the information processor 100, a hinge portions 130 for connecting the display portion 120 to the input portion 110 in a hinged manner to accommodate the opening or closing of the display, a communication circuit 140 which generates a signal to be transmitted in wireless communication, and which converts a signal received in wireless communication into data used by the information processor 100, and antenna units 200*a* and 200*b* each of which radiates a wireless communication radio wave by being supplied with a signal generated by the communication circuit 140, and each of which supplies the communication circuit 140 with a signal received in wireless communication.

The information processor 100 in this embodiment is used, for example, in common for wireless communication in the 5 GHz band used in IEEE802.11a and for wireless communication in the 2.45 GHz band used in IEEE802.11 b/g and Bluetooth. The high-performance antenna units 200*a* and 200*b* designed so that variations in characteristics depending on the kinds of information processor 100, variations in the positions of parts and wiring, etc., are limited are provided to realize high wireless communication performance.

FIG. 2 shows the structure of the antenna unit 200*a* in accordance with an embodiment of the present invention. FIG. 2(*a*) is a view of the antenna unit 200*a* in accordance with an embodiment of the present invention as seen from the input portion 110 side of the display portion 120. FIG. 2(*b*) is a view of the antenna unit 200*a* in accordance with an embodiment of the present invention as seen in a direction toward a side surface of the display portion 120. FIG. 2(*c*) is a perspective view of the antenna unit 200*a* in accordance with an embodiment of the present invention.

The antenna unit 200*a* is provided on a side surface on the right as one faces the display surface of the display portion 120. The antenna unit 200*a* is used in common for wireless communication in a first frequency band, e.g., the 2.45 GHz band and for wireless communication in a second frequency band, e.g., the 5 GHz band. The antenna unit 200*a* has a radio wave resonance part 210*a*, an antenna ground part 220*a*, a connection part 230*a*, a feeder 240*a*, and a reinforcing member 250*a*.

The radio wave resonance part 210*a* transmits/receives radio waves. The radio wave resonance part 210*a* receives electric signal to be transmitted from the communication circuit 140 by resonating with the signal to transmit a radio wave, and receives a wireless communication radio wave by resonating with the radio wave to supply a radio wave signal to the communication circuit 140. The radio wave resonance part 210*a* is used in common in the first and second frequency bands for transmission and reception of radio waves. However, the radio wave resonance part 210*a* is designed so as to be most suitable for wireless communication in the first frequency band.

The radio wave resonance part 210*a* includes a radio wave resonance side part 214*a* which extends from the antenna ground part 220*a* along the display direction of the display portion 120, and a radio wave resonance upper part 212*a* which extends from the radio wave resonance side part 214*a* so as to be closer to the display portion 120. In this embodiment, the radio wave resonance upper part 212*a* is opposed to the antenna ground part 220*a* in a state of extending generally parallel to the antenna ground part 220*a*. The radio wave resonance side part 214*a* in this embodiment has at least its portion extended in a direction along a longer side of the radio wave resonance upper part 212*a*, its one end connected to the antenna ground part 220*a*, and the other end connected to the radio wave resonance upper part 212*a*. The radio wave resonance upper part 212*a* and the radio wave resonance side part 214*a* form a generally U-shaped member.

The radio wave resonance upper part 212*a* functions as a first radio wave resonance element in accordance with the present invention and is used for transmission and reception of a radio wave of a first frequency in the first frequency band. On the other hand, the radio wave resonance side part 214*a* functions as a second radio wave resonance element in accordance with the present invention and is used for transmission and reception of a radio wave of a second frequency in the second frequency band. The first frequency is lower than the second frequency, and the radio wave resonance upper part 212*a* is used for transmission or reception of a radio wave of a longer wavelength in comparison with the radio wave resonance side part 214*a*.

The antenna ground part 220*a* is electrically connected to the radio wave resonance part 210*a* and functions as a ground surface connected to ground. The antenna ground part 220*a* may be electrically connected by being formed integrally with the radio wave resonance part 210*a*. In such a case, the antenna ground part 220*a* may be formed by pressing from one sheet metal as a part integral with the radio wave resonance part 210*a*. Alternatively, the antenna ground part 220*a* may be cast in one die as a part integral with the radio wave resonance part 210*a*. In this embodiment, the antenna ground part 220*a* has such a trapezoidal shape that the longer one of its parallel sides is adjacent and parallel to a side surface of the display portion 120.

The antenna ground part 220*a* extends outward from the side surface of the display portion 120 away from the display portion 120 generally parallel to the display surface of the display portion 120. The radio wave resonance part 210*a* is provided at the side of the antenna ground part 220*a* remoter from the display portion 120. Consequently, the antenna ground part 220*a* can prevent the radio wave resonance part 210*a* from being influenced by the feeder 240*a* laid along the side surface of the display portion 120.

It is desirable that the antenna ground part 220*a* be positioned adjacent to a region on the display direction side of the display surface of the display portion 120 (i.e., on the radio wave resonance part 210*a* side) and on the display surface 120 side of the radio wave resonance part 210*a*, as shown in FIG. 2(*a*), thereby enabling the antenna ground part 220*a* to prevent the radio wave resonance part 210*a* from being influenced by signal conductors, a ground part, etc., in the display portion 120.

The connection part 230*a* fixes the antenna ground part 220*a* so that the antenna ground part 220*a* is positioned closer to the connection part 230*a* than ground parts of the information processor 100 other than the antenna ground part 220*a*, e.g., the display portion 120. By fixing the antenna ground part 220*a* in this manner, the connection part 230*a* can prevent the characteristics of the antenna unit 200*a* from being influenced by another ground part etc., of the information processor 100. The connection part 230*a* may be formed integrally with the radio wave resonance part 210*a* and the antenna ground part 220*a*. The connection part 230*a* includes a feeder fixing part 260*a* for fixing the feeder 240*a* on the connection part 230*a* and attachment holes 270*a* which are screw holes or the like for fixing the antenna unit 200*a* on the display portion 120.

The feeder 240*a* is a wiring line, e.g., a coaxial cable or the like which connects the communication circuit 140 and the antenna unit 200*a*. The feeder 240*a* is laid to the radio wave resonance part 210*a* at a distance from the antenna ground part 220*a*. A shielding conductor in the feeder 240*a* is connected to the antenna ground part 220*a* at a shielding connection part 242*a* on the opposite side of the antenna ground part 220*a* from the radio wave resonance part 210*a*. In this manner, the antenna characteristics of the radio wave resonance part 210*a* can be prevented from being affected by variation in the laid position of the feeder 240*a* or variation in the state of the connection made by soldering or the like at the shielding connection part 242*a*.

A signal conductor which is a core conductor of the feeder 240*a* extends from the shielding connection part 242*a* to be connected to the radio wave resonance part 210*a* at a signal connection part 244*a*. The signal conductor of the feeder 240*a* is laid to the signal connection part 244*a* from an end of the antenna ground part 220*a* in a direction along the side surface direction of the display portion 120, which end is closer to the signal connection part 244*a*. In this manner, the influence of the core conductor of the feeder 240*a* on the antenna characteristics of the radio wave resonance part 210*a* can be limited.

The reinforcing member 250*a* is provided between the radio wave resonance upper part 212*a*, which is a flat portion in the radio wave resonance part 210*a* parallel to the antenna ground part 220*a*, and the antenna ground part 220*a* to maintain the spacing between the radio wave resonance upper part 212*a* and the antenna ground part 220*a* at a design value and to reinforce the antenna unit 200*a*. For ease of illustration, the reinforcing member 250*a* is omitted in the FIGS. 2(*a*) and 2(*c*).

FIG. 3 shows the structure of the antenna unit 200*b* in accordance with an embodiment of the present invention. FIG. 3(*a*) is a view of the antenna unit 200*b* in accordance with an embodiment of the present invention as seen from the input portion 110 side of the display portion 120. FIG. 3(*b*) is a view of the antenna unit 200*b* in accordance with an embodiment of the present invention as seen in a direction toward a side surface of the display portion 120. FIG. 3(*c*) is a perspective view of the antenna unit 200*b* in accordance with an embodiment of the present invention.

The antenna unit 200*b* is provided on a side surface on the left as one faces the display surface of the display portion 120. The antenna unit 200*b* is used in common for wireless communication in the first frequency band and for wireless communication in the second frequency band. The antenna unit 200*b* has an approximately symmetrical relationship with the antenna unit 200*a* with respect to the display portion 120. The antenna unit 200*b* has a radio wave resonance part 210*b*, an antenna ground part 220*b*, a connection part 230*b*, a feeder 240*b*, and a reinforcing member 250*b*. These parts of the antenna unit 200*b* have the same structures and functions as those of the corresponding parts of the antenna unit 200*a*.

The radio wave resonance part 210*b* is used in common in the first and second frequency bands for transmission and reception of radio waves, as is the radio wave resonance part 210*a*. The radio wave resonance part 210*b* is designed so as to be most suitable for wireless communication in the second frequency band. The gain of the radio wave resonance part 210*b* in the first frequency band is lower than that of the radio wave resonance part 210*a*, while the gain of the radio wave resonance part 210*b* in the second frequency band is higher than that of the radio wave resonance part 210*a*. Therefore the communication circuit 140 can perform wireless communication by selecting the antenna unit 200 from the antenna units 200*a* and 200*b*, with which higher wireless communication performance can be achieved.

The antenna unit 200*b* arranged to realize the above-described different characteristics differs from the antenna unit 200*a* in the following respects. The radio wave resonance upper part 212*b* is shorter than the radio wave resonance upper part 212*a* and is formed in such a manner that an end portion of the radio wave resonance upper part 212*a* at a side where the upper part is not connected to the radio wave resonance side part 214*a* is removed. The radio wave resonance side part 214*b* is formed in such a manner that its portion closer to the antenna ground part 220*b* in an end portion connected to the radio wave resonance upper part 212*b* is removed in comparison with the corresponding portion of the radio wave resonance side part 214*a*. For impedance matching with respect to a difference in impedance due to these points of difference, the signal connection part 244*b* is provided at an intermediate portion in the radio wave resonance side part 214*b* in the direction along the longer side of the radio wave resonance upper part 212*b*.

FIG. 4 shows the configuration of an antenna part 205 which is a part for the antenna unit 200*a* and 200*b* in accordance with an embodiment of the present invention. The antenna part 205 in this embodiment is formed by pressing from one sheet metal.

When the antenna part 205 is used as the antenna unit 200*a*, it is worked as described below. First, a portion 400*a* to be removed, which is a portion closer to an antenna ground part 220, is removed from a radio wave resonance side part 214 at an end at which the radio wave resonance side part 214 is connected to a radio wave resonance upper part 212. The radio wave resonance side part 214*b* is thereby formed so that the portion corresponding to the portion 400*a* to be removed in the radio wave resonance side part 214*a* is removed. A feeder fixing part 260 is bent toward the back surface of a connection part 230 as seen in the frontal direction of the figure to hold the feeder 240*a*, and the antenna ground part 220 is bent rearward relative to the connection part 230 so as to be approximately perpendicular to the connection part 230.

The radio wave resonance side part 214 is bent frontward relative to the antenna ground part 220 so as to be approximately perpendicular to the antenna ground part 220, and the radio wave resonance upper part 212 is bent frontward relative to the radio wave resonance side part 214 so as to be approximately perpendicular to the radio wave resonance side part 214.

When, the antenna part 205 is used as the antenna unit 200*b*, it is worked as described below. First, a portion 400*b* to be removed, which is a portion at an end at which the radio wave resonance upper part 212 is not connected to the radio wave resonance side part 214, is removed. The radio wave resonance upper part 212*b* is thereby formed so that the portion corresponding to the portion 400*b* to be removed in the radio wave resonance upper part 212*a* is removed. The feeder fixing part 260 is bent frontward relative to the connection part 230 as seen in the frontal direction of the figure to hold the feeder 240*b*, and the antenna ground part 220 is bent frontward relative to the connection part 230 so as to be approximately perpendicular to the connection part 230.

The radio wave resonance side part 214 is bent rearward relative to the antenna ground part 220 so as to be approximately perpendicular to the antenna ground part 220, and the radio wave resonance upper part 212 is bent rearward relative to the radio wave resonance side part 214 so as to be approximately perpendicular to the radio wave resonance side part 214.

The antenna ground part 220 and the radio wave resonance part 210 are integrally formed from the antenna part 205. In this manner, the antenna characteristics can be prevented from being varied due to an error in the mount position of the antenna ground part 220 with respect to the radio wave resonance part 210, variation in the amount of solder in the case of mounting the radio wave resonance part 210 to the antenna ground part 220 by soldering, etc. FIG. 5 shows voltage standing wave ratio (VSWR) characteristics of an antenna not having the antenna ground part 220. FIG. 6 shows VSWR characteristics of the antenna unit 200*a* in this embodiment. Each of FIGS. 5 and 6 shows VSWR characteristics in the 2.45 GHz band of models A, B, and C in a case where a display panel X (liquid crystal display X) is mounted and in a case where a display panel Y (liquid crystal display Y) is mounted.

In the case where the antenna ground part 220 is not provided, the VSWR characteristic varies largely depending on the model and the kind of the display panel. In particular, due to the difference between the display panels, the frequency at which the VSWR is minimized changes largely in the range from about 2.4 GHz to about 2.5 GHz. This shows that the antenna impedance varies due to the difference between the display panels in the case of use of one antenna. In the 2.45 GHz band, the frequency band used for wireless communication has a bandwidth of 100 MHz. Therefore, antennas not having the antenna ground part 220 individually need impedance matching, for example, by changing the position of the signal connection part 244*a* according to the model of the information processor 100 and the kind of the display portion 120.

In the case of the antenna unit 200*a*, variations in the VSWR characteristic depending on the models and the kind of the display panel are limited in comparison with the case where the antenna ground part 220 is not provided. In particular, even when the display panel is changed, the change in the frequency at which the VSWR is minimized can be limited within the range from about 2.45 GHz to about 2.47 GHz. Consequently, the antenna unit 200*a* is capable of limiting the VSWR to 1.5 or less in the range from 2.4 GHz to 2.5 GHz, and favorable communication characteristics can be provided by using the same antenna unit 200*a* regardless of the models of the information processor 100 and the kind of the display panel 120.

While the present invention has been described with respect to the embodiment, the technical scope of the present invention is not limited to the scope described above with respect to the various embodiments. Various changes and modifications can be made in the above-described embodiment. From the description of the appended claims, it is apparent that forms of the present invention including such changes or modifications are also included in the technical scope of the present invention.

What is claimed is:

1. An antenna unit provided in a wireless communication apparatus which performs wireless communication, said antenna unit comprising:

a radio wave resonance part through which a radio wave is transmitted or received;

an antenna ground part electrically connected to said radio wave resonance part;

a connection part which fixes said antenna ground part at such a position that said antenna ground part is closer to said radio wave resonance part than other non-antenna ground parts of the wireless communication apparatus;

wherein the wireless communication apparatus has a display panel and said antenna ground part extends outward from a side surface of the display panel away from the display panel;

wherein said radio wave resonance part has:

a radio wave resonance side part extending from said antenna ground part along the display direction of the display panel; and a radio wave resonance upper part opposed to said antenna ground part and extending from said radio wave resonance side part so as to be closer to the display panel.

2. An antenna unit provided in a wireless communication apparatus which performs wireless communication, said antenna unit comprising:

a radio wave resonance part through which a radio wave is transmitted or received;

an antenna ground part electrically connected to said radio wave resonance part;

a connection part which fixes said antenna ground part at such a position that said antenna ground part is closer to said radio wave resonance part than other non-antenna ground parts of the wireless communication apparatus;

wherein said radio wave resonance part has:

a first radio wave resonance element; and a second radio wave resonance element having at least a portion extending in a direction along a longer side of said first radio wave resonance element, its one end connected to said antenna ground part, and the other end connected to said first radio wave resonance element, wherein said first radio wave resonance element transmits or receives a radio wave longer in wavelength than a radio wave transmitted or received by said second radio wave resonance element.

* * * * *

UNITED STATES PATENT AND TRADEMARK OFFICE

CERTIFICATE OF CORRECTION

PATENT NO. : 6,972,722 B2
APPLICATION NO. : 10/730322
DATED : December 6, 2005
INVENTOR(S) : Katoh et al.

It is certified that error appears in the above-identified patent and that said Letters Patent is hereby corrected as shown below:

On the Title Page (56) add the following:

FOREIGN PATENT DOCUMENTS

JP 2000-174527 6/23/2000

Signed and Sealed this

Eleventh Day of September, 2007

JON W. DUDAS
*Director of the United States Patent and Trademark Office*